US010679576B2

(12) United States Patent
Tomizawa

(10) Patent No.: US 10,679,576 B2
(45) Date of Patent: Jun. 9, 2020

(54) DISPLAY DEVICE

(71) Applicant: Japan Display Inc., Tokyo (JP)

(72) Inventor: Kazunari Tomizawa, Tokyo (JP)

(73) Assignee: Japan Display Inc., Tokyo (JP)

( * ) Notice: Subject to any disclaimer, the term of this patent is extended or adjusted under 35 U.S.C. 154(b) by 0 days.

(21) Appl. No.: 16/363,692

(22) Filed: Mar. 25, 2019

(65) Prior Publication Data

US 2019/0304387 A1 Oct. 3, 2019

(30) Foreign Application Priority Data

Mar. 27, 2018 (JP) ..... 2018-060123

(51) Int. Cl.
*G09G 3/36* (2006.01)

(52) U.S. Cl.
CPC ... *G09G 3/3607* (2013.01); *G09G 2300/0452* (2013.01); *G09G 2320/0233* (2013.01); *G09G 2320/0242* (2013.01)

(58) Field of Classification Search
CPC ..... G09G 3/3607; G09G 2300/0452; G09G 2320/0242; G09G 2320/0233; G09G 3/20
See application file for complete search history.

(56) References Cited

U.S. PATENT DOCUMENTS 7,277,075 B1 * 10/2007 Hirano ..... G09G 3/3607 345/690
2005/0140614 A1 * 6/2005 Baek ..... G09G 3/3648 345/87
2007/0159492 A1 * 7/2007 Lo ..... G09G 5/026 345/589
2007/0257943 A1 * 11/2007 Miller ..... G09G 3/3225 345/694
2007/0257945 A1 * 11/2007 Miller ..... G09G 3/2003 345/694
2013/0241810 A1 * 9/2013 Higashi ..... G09G 3/3406 345/77
2018/0061368 A1 * 3/2018 Sako ..... G06T 5/007

FOREIGN PATENT DOCUMENTS

JP 2015-197461 A 11/2015

* cited by examiner

*Primary Examiner* — Carolyn R Edwards

(74) *Attorney, Agent, or Firm* — K&L Gates LLP

(57) ABSTRACT

A display device includes: a display unit including sub-pixels; and a signal processor configured to output output signals based on pixel data. A set of the sub-pixels includes first to fourth sub-pixels. The fourth sub-pixel is assigned a first color component as a white component in one of the two pieces of the pixel data arranged in one direction. The first to third sub-pixels are assigned second color components other than the first color component. When a signal level for lighting one or more of the first to third sub-pixels in the set of the sub-pixels is at a first level, and a signal level for one or more of the first to third sub-pixels is at a second level lower than the first level, the signal processor increases the signal levels corresponding to the second color components as a signal level corresponding to the first color component increases.

6 Claims, 10 Drawing Sheets

DISPLAY DEVICE

CROSS-REFERENCE TO RELATED APPLICATIONS

This application claims priority from Japanese Application No. 2018-060123, filed on Mar. 27, 2018, the contents of which are incorporated by reference herein in its entirety.

BACKGROUND

1. Technical Field

The present disclosure relates to a display device.

2. Description of the Related Art

Methods are known (for example, in Japanese Patent Application Laid-open Publication No. 2015-197461 (JP-A-2015-197461)) in which image data with a predetermined resolution composed of a predetermined number of pixels is displayed with pixels the number of which is smaller than the predetermined number.

As described in JP-A-2015-197461, in methods of displaying image data of a predetermined resolution composed of a predetermined number of pixels with pixels the number of which is smaller than the predetermined number, a bright-and-dark pattern not included in an input image is sometimes unintentionally displayed depending on how colors are assigned.

There is a need for a display device capable of restraining the generation of the unintended bright-and-dark pattern.

SUMMARY

According to an aspect, a display device includes: a display unit in which a plurality of sub-pixels are arranged in a matrix along row and column directions; and a signal processor configured to output output signals generated based on signals constituting image data in which pixel data including three colors of red, green, and blue is arranged in a matrix. A set of the sub-pixels includes a first sub-pixel for red, a second sub-pixel for green, a third sub-pixel for blue, and a fourth sub-pixel for white. Either the first sub-pixel or the third sub-pixel is interposed between the second sub-pixel and the fourth sub-pixel arranged in one direction of the row direction and the column direction. Color components assigned to two pieces of the pixel data arranged in the one direction are assigned to one set of the sub-pixels included in the display unit. The one set of the sub-pixels is made up of the first sub-pixel, the second sub-pixel, the third sub-pixel, and the fourth sub-pixel. The fourth sub-pixel is assigned a first color component serving as a white component included in one piece of the pixel data among the color components included in the two pieces of the pixel data. The first sub-pixel, the second sub-pixel, and the third sub-pixel are assigned second color components other than the first color component of the color components included in the two pieces of the pixel data. When, of signal levels for controlling lighting of the sub-pixels corresponding to the second color components, a signal level for lighting one or more of the first sub-pixel, the second sub-pixel, and the third sub-pixel included in the set of the sub-pixels is at a first signal level, and a signal level for one or more of the first sub-pixel, the second sub-pixel, and the third sub-pixel is at a second signal level lower than the first signal level, the signal processor increases the signal levels corresponding to the second color components as a signal level corresponding to the first color component increases.

DETAILED DESCRIPTION

Figure 1:
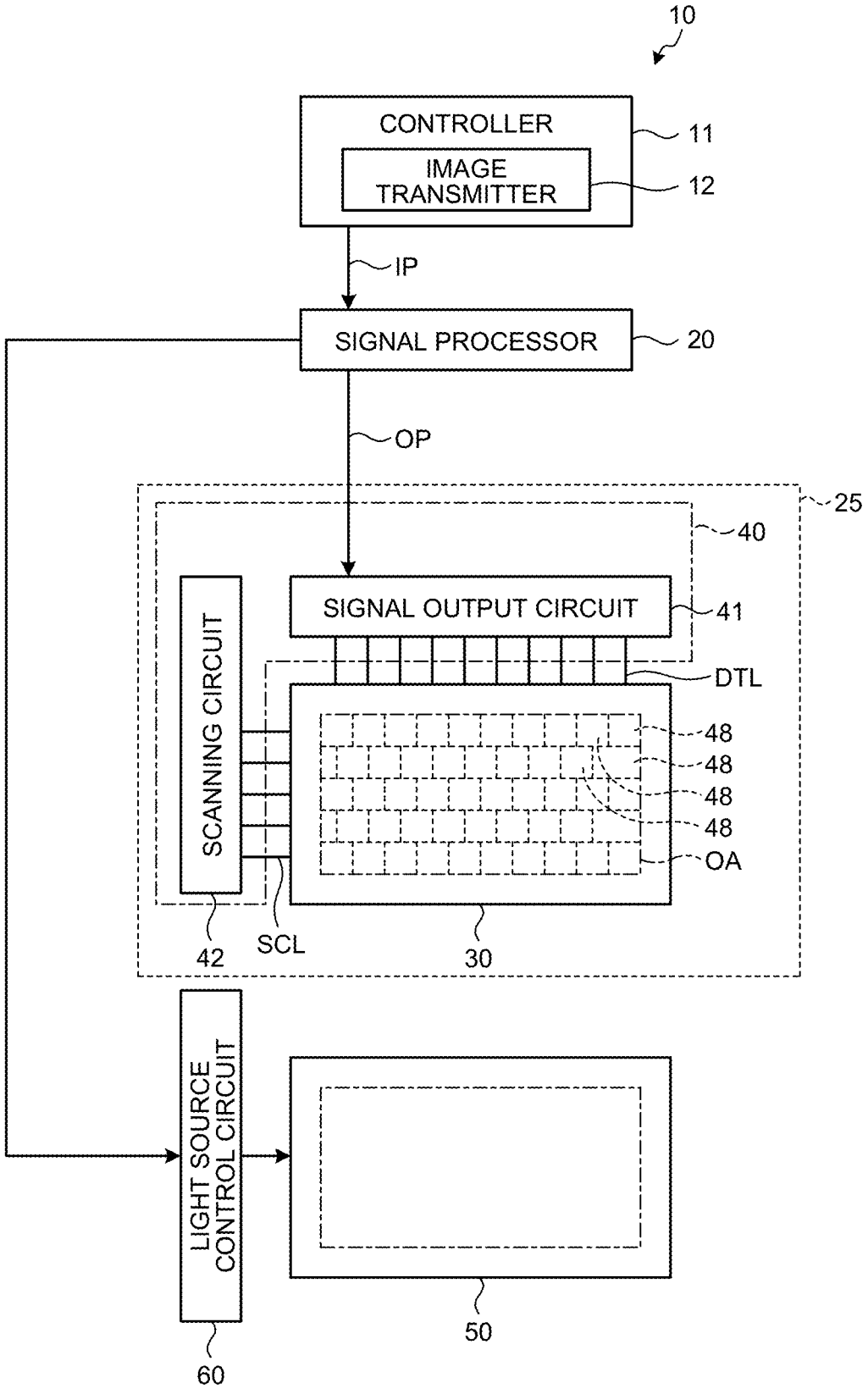
FIG. 1 is a block diagram illustrating an exemplary configuration of a display device according to an embodiment.

The following describes embodiments of the present invention with reference to the drawings. The disclosure is merely an example, and the present invention naturally encompasses appropriate modifications easily conceivable by those skilled in the art while maintaining the gist of the invention. To further clarify the description, widths, thicknesses, shapes, and the like of various parts are schematically illustrated in the drawings as compared with actual aspects thereof, in some cases. However, they are merely examples, and interpretation of the present invention is not limited thereto. The same element as that illustrated in a drawing that has already been discussed is denoted by the same reference numeral through the description and the drawings, and detailed description thereof will not be repeated in some cases where appropriate.

In this disclosure, when an element is described as being "on" another element, the element can be directly on the other element, or there can be one or more elements between the element and the other element.

EMBODIMENT

Figure 2:
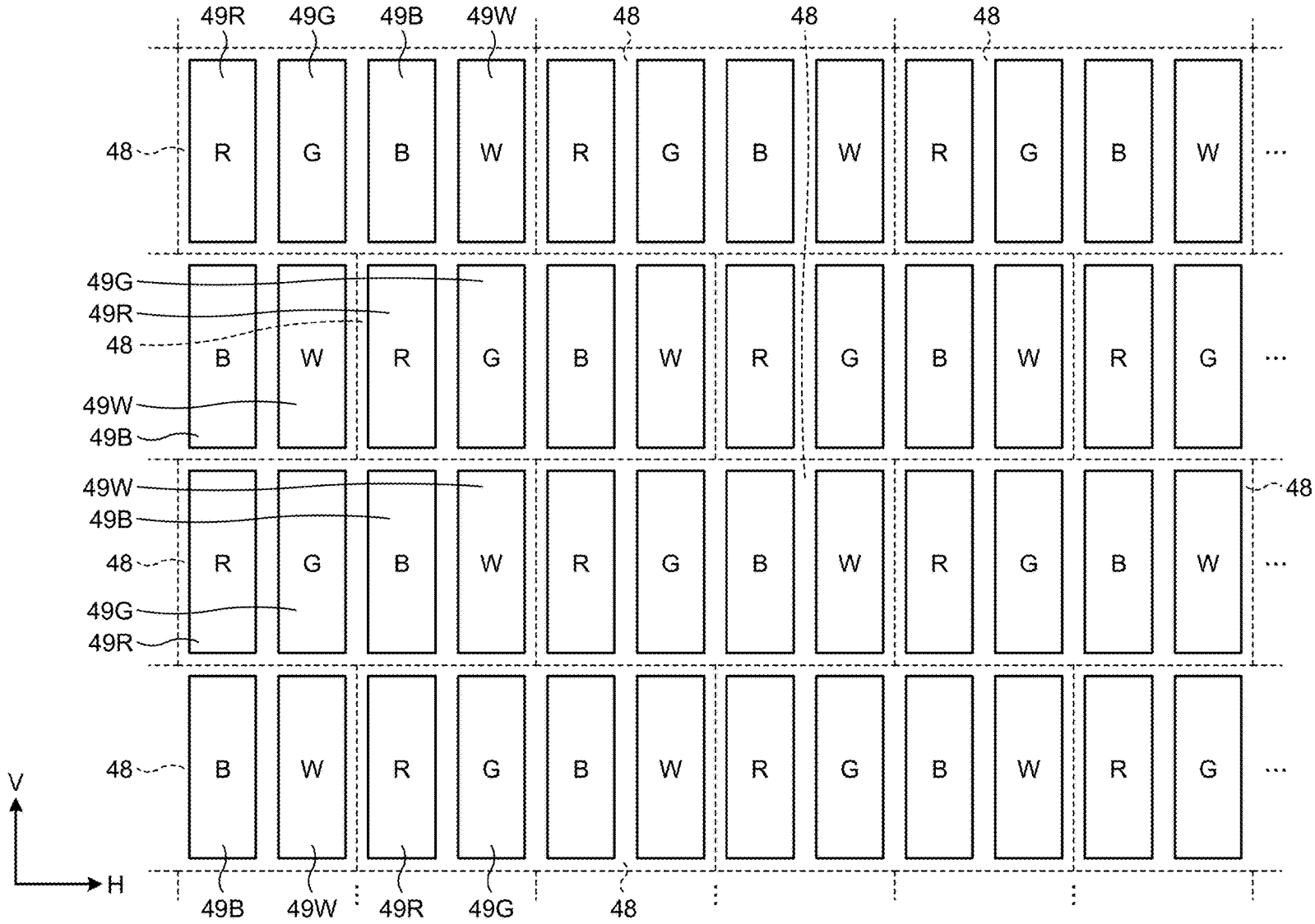
FIG. 2 is a schematic diagram illustrating an array of pixels and sub-pixels of an image display panel according to the embodiment.
Figure 3:
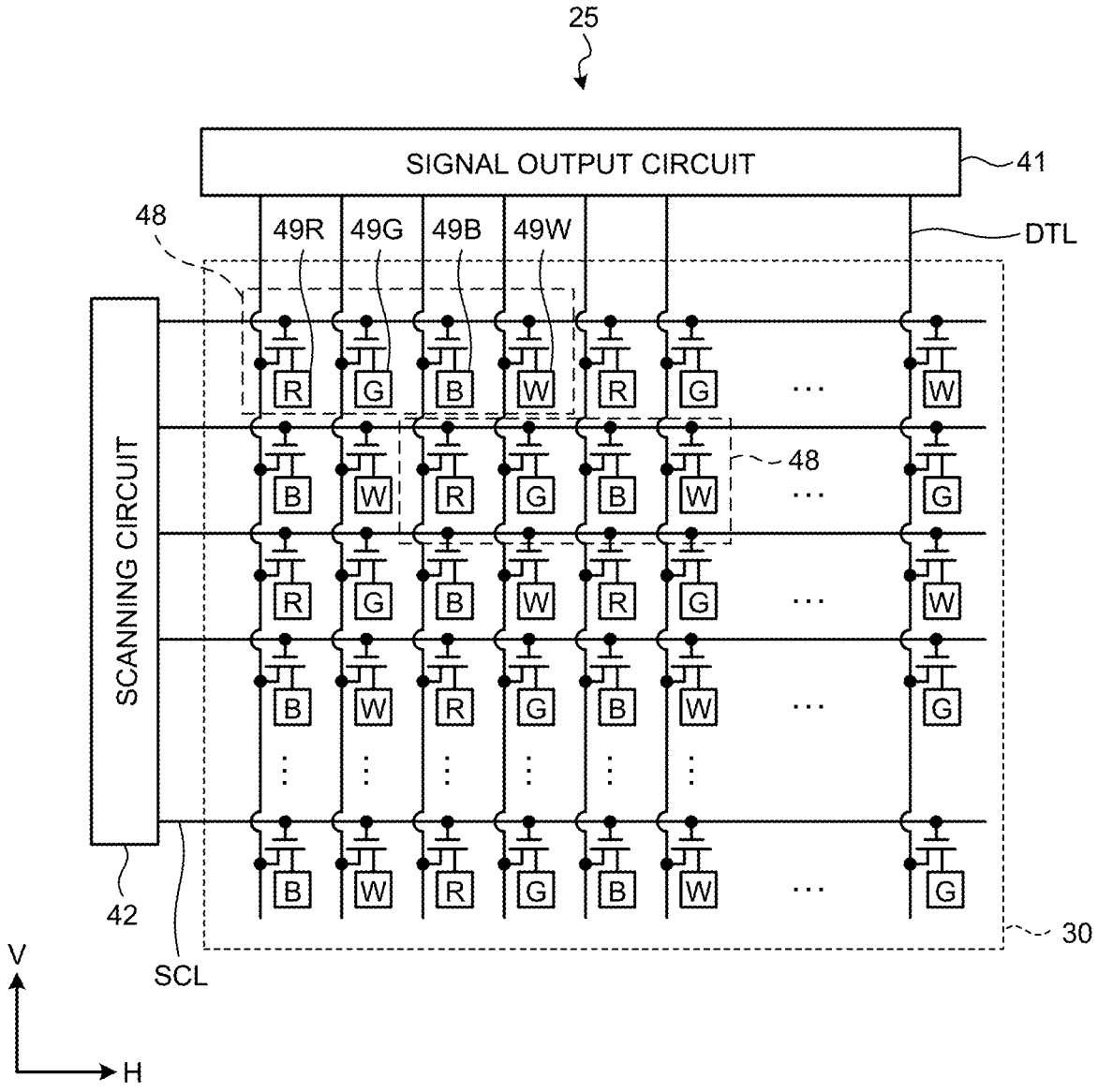
FIG. 3 is a conceptual diagram of the image display panel and an image display panel drive circuit of the display device according to the embodiment.

FIG. 1 is a block diagram illustrating an exemplary configuration of a display device 10 according to an embodiment. FIG. 2 is a schematic diagram illustrating an array of pixels 48 and sub-pixels 49 of an image display panel according to the embodiment. FIG. 3 is a conceptual diagram of the image display panel and an image display panel drive circuit of the display device 10 according to the embodiment.

As illustrated in FIG. 1, the display device 10 includes a signal processor 20, an image display panel 30, an image display panel drive circuit 40, a planar light source device 50, and a light source control circuit 60. The signal processor 20 receives input signals IP (RGB data) from an image transmitter 12 of a controller 11 and performs prescribed data conversion processing to output output signals OP. The image display panel 30 displays an image based on the output signals OP output from the signal processor 20. The image display panel drive circuit 40 controls driving of the image display panel 30. The planar light source device 50 illuminates the image display panel 30, for example, from the back side thereof. The light source control circuit 60 controls driving of the planar light source device 50. In the embodiment, a component including the image display panel 30 and the image display panel drive circuit 40 serves as a display unit 25.

The signal processor 20 synchronously controls operations of the image display panel 30 and the planar light source device 50. The signal processor 20 is coupled to the image display panel drive circuit 40 for driving the image display panel 30 and to the light source control circuit 60 for driving the planar light source device 50. The signal processor 20 processes the externally received input signals IP to generate the output signals OP and a light source control signal. More specifically, the signal processor 20 converts input values (input signals IP) in an input HSV (Hue-Saturation-Value, Value is also called Brightness) color space of the input signals IP representing color components of three colors of R, G, and B into reproduced values (output signals OP) in an extended HSV color space reproduced by color components of four colors of R, G, B, and W, and outputs the output signals OP based on the thus converted values to the image display panel drive circuit 40. The signal processor 20 outputs the light source control signal corresponding to the output signals OP to the light source control circuit 60.

Figure 4:
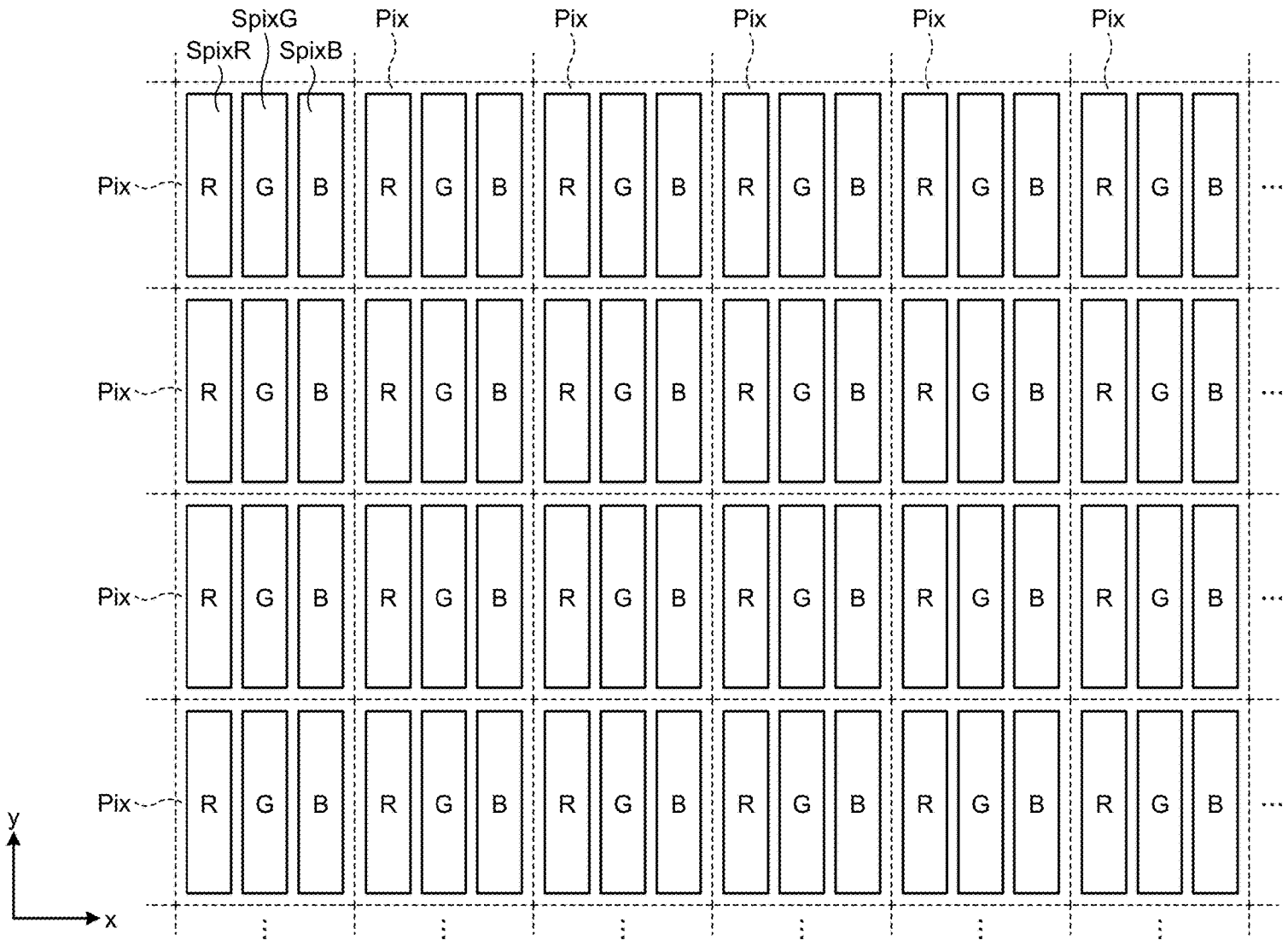
FIG. 4 is a schematic diagram of image data based on input signals.

FIG. 4 is a schematic diagram of image data based on the input signals IP. The image transmitter 12 outputs, as the input signals IP, signals constituting the image data in which pixel data Pix obtained by combining the three colors of R, G, and B is arranged in a matrix (row-column configuration), as illustrated in FIG. 4. The pixel data Pix corresponds to pixels in the input signals. In, for example, FIG. 4, of pieces of sub-pixel data of three colors constituting the pixel data Pix, red sub-pixel data is denoted by SpixR, green sub-pixel data is denoted by SpixG, and blue sub-pixel data is denoted by SpixB.

As illustrated in FIGS. 2 and 3, the image display panel 30 has a display area OA in which the pixels 48 are arranged in a staggered manner in a two dimensional HV coordinate system. In this example, the row direction corresponds to the H-direction, and the column direction corresponds to the V-direction. For the purpose of distinction between the array of the pixels 48 and the array of the pixel data Pix, the row direction and the column direction in the array of the pixels 48 are denoted by the H-direction and the V-direction, and the row direction and the column direction in the array of the pixel data Pix are denoted by an x-direction and a y-direction.

Each of the pixels 48 includes a first sub-pixel 49R, a second sub-pixel 49G, a third sub-pixel 49B, and a fourth sub-pixel 49W. The first sub-pixel 49R emits light in red (R). The second sub-pixel 49G emits light in green (G). The third sub-pixel 49B emits light in blue (B). The fourth sub-pixel 49W emits light in white (W). The chromaticity of white (W) reproduced by the fourth sub-pixel 49W is substantially equal to the chromaticity of white reproduced by uniform lighting of the three color sub-pixels 49: the first, second, and third sub-pixels 49R, 49G, and 49B. Hereinafter, the first sub-pixel 49R, the second sub-pixel 49G, the third sub-pixel 49B, and the fourth sub-pixel 49W will each be referred to as a sub-pixel 49 when they need not be distinguished from one another. In other words, the pixel 48 is one form of a set of the sub-pixels 49 including one first sub-pixel 49R, one second sub-pixel 49G, one third sub-pixel 49B, and one fourth sub-pixel 49W.

The display device 10 is, for example, a transmissive color liquid crystal display device. In this example, the image display panel 30 is a color liquid crystal display panel, on which a first color filter for transmitting light in red (R) is provided between the first sub-pixel 49R and an image viewer; a second color filter for transmitting light in green (G) is provided between the second sub-pixel 49G and the image viewer; and a third color filter for transmitting light in blue (B) is provided between the third sub-pixel 49B and the image viewer. No color filter is disposed between the fourth sub-pixel 49W on the image display panel 30 and the image viewer. A transparent resin layer, instead of a color filter, may be provided on the fourth sub-pixel 49W. In this way, when the transparent resin layer is provided, the image display panel 30 can restrain a large step from being formed on the fourth sub-pixel 49W by not providing the color filter on the fourth sub-pixel 49W.

In the pixel 48, the sub-pixels 49 are arranged periodically in the order of the first sub-pixel 49R, the second sub-pixel 49G, the third sub-pixel 49B, and the fourth sub-pixel 49W from one side toward the other side in the H-direction. In other words, the first sub-pixel 49R or the third sub-pixel 49B is present between the second sub-pixel 49G and the fourth sub-pixel 49W arranged in one direction (for example, the H-direction).

As illustrated in FIG. 2, the sub-pixels 49 of two colors are alternately arranged along the V-direction. Specifically, a first sub-pixel column and a second sub-pixel column are alternately arranged in the H-direction. The first sub-pixel column is a column of the sub-pixels 49 in which the first sub-pixel 49R and the third sub-pixel 49B are alternately arranged along the V-direction, and the second sub-pixel column is a column of the sub-pixels 49 in which the second sub-pixel 49G and the fourth sub-pixel 49W are alternately arranged along the V-direction. In other words, the first sub-pixels 49R are arranged in a staggered manner; the second sub-pixels 49G, the third sub-pixels 49B, and the fourth sub-pixels 49W are also arranged in a staggered manner in the same way as the first sub-pixels 49R. In this way, in the embodiment, the colors of the sub-pixels 49 are arranged in a staggered manner.

The image display panel drive circuit 40 includes a signal output circuit 41 and a scanning circuit 42. The image display panel drive circuit 40 holds video signals in the signal output circuit 41, and sequentially outputs them to the image display panel 30. The signal output circuit 41 is electrically coupled to the image display panel 30 through wiring DTL. The image display panel drive circuit 40 uses the scanning circuit 42 to control on and off operation of a switching element (such as a thin-film transistor (TFT)) for controlling operation (such as display luminance, that is, light transmittance in this case) of the sub-pixel on the image display panel 30. The scanning circuit 42 is electrically coupled to the image display panel 30 through wiring SCL. In the display unit 25, to drive the sub-pixels 49, the scanning circuit 42 performs scanning in the other direction (for example, the V-direction) of the row and column directions, that is, along a direction of arrangement of the wiring SCL.

The planar light source device 50 is provided on the back side of the image display panel 30, and emits light toward the image display panel 30 to illuminate the image display panel 30. The planar light source device 50 emits the light to the entire surface of the image display panel 30 to illuminate the image display panel 30. The planar light source device 50 may have a front light configuration of being provided on the front side of the image display panel 30. Alternatively, a light-emitting display (such as an organic light emitting diode (OLED) display) can be used as the image display panel 30. In this case, the planar light source device 50 can be made unnecessary.

The light source control circuit 60 controls, for example, the irradiation light quantity of light emitted from the planar light source device 50. Specifically, the light source control circuit 60 adjusts the duty cycle of a signal, a current, or a voltage supplied to the planar light source device 50 based on the light source control signal that is output from the signal processor 20, thereby controlling the irradiation light quantity (light intensity) of the light with which the image display panel 30 is irradiated.

The following describes signal processing by the signal processor 20. The signal processor 20 outputs the output signals OP to the image display panel drive circuit 40 of the display unit 25. The output signal OP assigns, to one pixel 48 included in the image display panel 30, color components assigned to two pieces of pixel data Pix arranged in one direction (for example, the x-direction) of the row and column directions in the input signals IP. Specifically, the image display panel 30 assigns a first color component to the fourth sub-pixel 49W included in the one pixel 48 and assigns second color components to the first, second, and third sub-pixels 49R, 49G, and 49B therein. The first color component is a part or the whole of a white component included in one piece of the pixel data Pix among the color components included in the two pieces of the pixel data Pix. The second color components are components other than the first color component of the color components included in the two pieces of the pixel data Pix.

The term "white component" refers to, among the color components, color components convertible to white. The term "color components convertible to white" refers to a combination MIN(R, G, B) of components obtained by evenly extracting color components corresponding to the lowest gradation value of gradation values (R, G, B) of red (R), green (G), and blue (B) in the input signals IP from the three colors. For example, when (R, G, B)=(100, 150, 50), the lowest gradation value is the gradation value 50 of blue (B). In this case, the white component is given as MIN(R, G, B)=(50, 50, 50).

Figure 5:
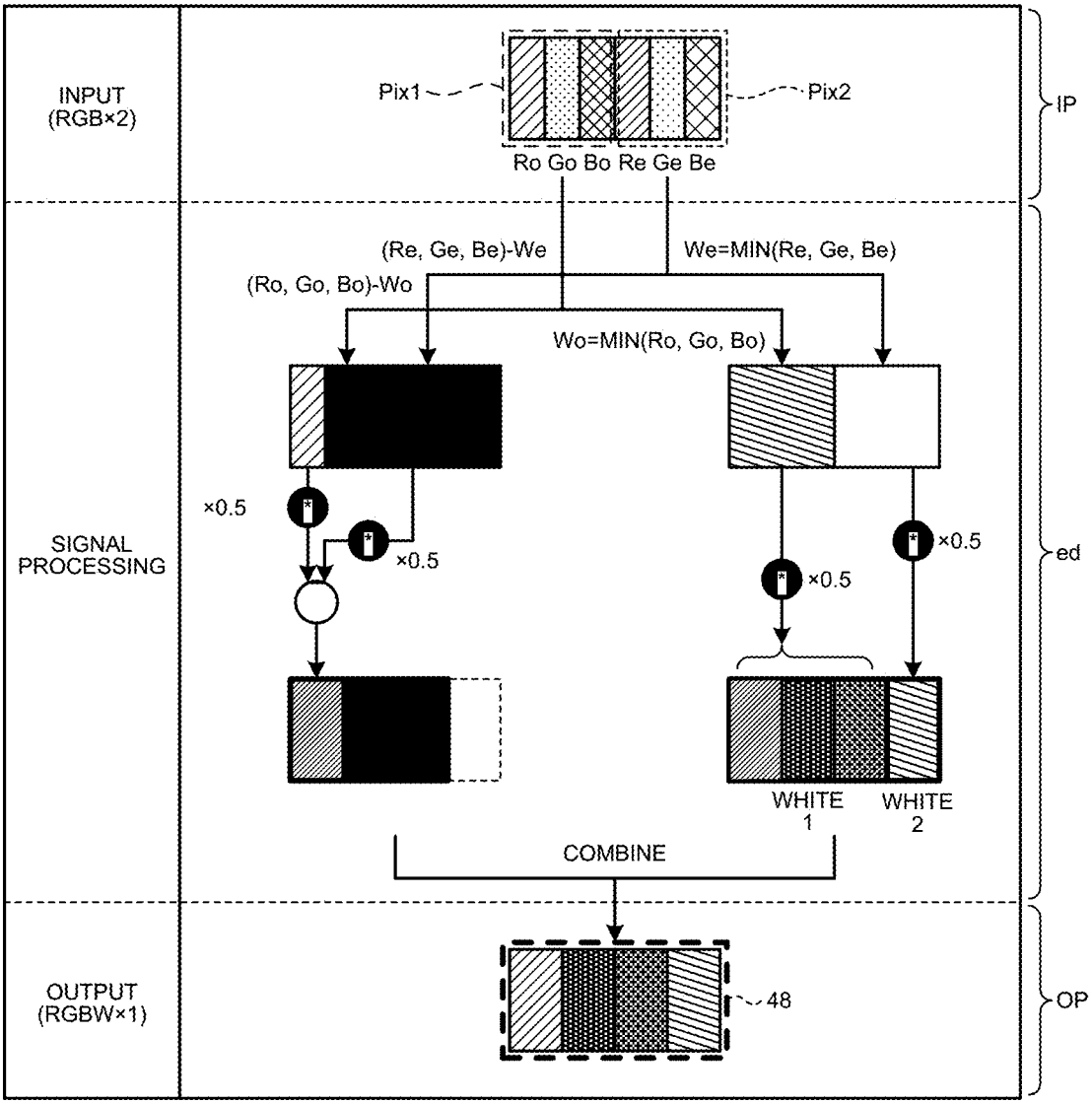
FIG. 5 is an explanatory diagram illustrating an example of signal processing performed by a signal processor.

FIG. 5 is an explanatory diagram illustrating an example of the signal processing performed by the signal processor 20. With reference to FIG. 5, the following describes signal processing ed performed by the signal processor 20 to generate the output signal OP that assigns the color components of two pieces of pixel data Pix1 and Pix2 included in the input signals IP to one pixel 48. In FIG. 5 and in FIG. 9 described later, (Ro, Go, Bo) denote the color components of red (R), green (G), and blue (B) received as the gradation values of the pixel data Pix1 among those of the input signals IP, and (Re, Ge, Be) denote the color components of red (R), green (G), and blue (B) received as the gradation values of the pixel data Pix2 among those of the input signals IP.

In the input signals IP illustrated in FIG. 5, the gradation values of the pixel data Pix1 are given as (Ro, Go, Bo)=(max, mid, mid). Here, max denotes the maximum value of the gradation values of red (R), green (G), and blue (B) in the input signals IP. For example, if the gradation values are expressed as 8-bit values, max=255. The value of mid is a gradation value (for example, max/2) lower than max. In the input signals IP of FIG. 5, the gradation values of the pixel data Pix2 are given as (Re, Ge, Be)=(max, max, max). In other words, the pixel data Pix2 represents white at the highest luminance.

The signal processor 20 generates the output signals OP based on the input signals IP. Specifically, in the case of the example illustrated in FIG. 5, the signal processor 20 assigns, to the fourth sub-pixel 49W, a white color component We of the color components represented by one (for example, the pixel data Pix2) of the two pieces of pixel data Pix1 and Pix2 as the first color component. The signal processor 20 assigns, to the first, second, and third sub-pixels 49R, 49G, and 49B, the second color components other than the first color component of the color components of the two pieces of pixel data Pix1 and Pix2. In other words, the first, second, and third sub-pixels 49R, 49G, and 49B are assigned the color components other than the white color component We of the color components of the two pieces of pixel data Pix1 and Pix2.

In the embodiment, the first color component is a white component included in one of the two pieces of the pixel data Pix arranged in one direction (for example, the x-direction) in the input signals IP that is closer to the arrangement position in one direction (for example, the H-direction) of the fourth sub-pixel 49W in one pixel 48. In other words, the arrangement of one of the two pieces of the pixel data Pix in the input signals that serves as a basis for a first color component corresponds to the arrangement of the fourth sub-pixel 49W included in one pixel 48 serving as a target of the output signal corresponding to the input signals. Accordingly, in the example illustrated in FIG. 5, a pixel including the white component handled as the first color component corresponds to the pixel data Pix2.

In the example illustrated in FIG. 5, the gradation values of the pixel data Pix2 are given as (Re, Ge, Be)=(max, max, max). Thus, the white color component We included in (Re, Ge, Be) is given as We=MIN(Re, Ge, Be)=(max, max, max). In other words, all of (Re, Ge, Be) are handled as the white color component We. Thus, in the example illustrated in FIG. 5, components ((Re, Ge, Be)−We) other than the white color component We of the color components of the pixel data Pix2 are given as (R, G, B)=(0, 0, 0). However, if a part or the whole of the color component of the pixel data Pix2 is a component not convertible to white, such component serves as the component other than the white color component We.

The signal processor 20 assigns, to the first, second, and third sub-pixels 49R, 49G, and 49B, the color components of the pixel data Pix1 and the components other than the white color component We of the color components of the pixel data Pix2. As described above, since the components other than the white color component We are given as (R, G, B)=(0, 0, 0) in the example illustrated in FIG. 5, the color components assigned to the first, second, and third sub-pixels 49R, 49G, and 49B are substantially color components corresponding to the gradation values (Ro, Go, Bo)=(max, mid, mid) of the pixel data Pix1.

The signal processor 20 extracts a white color component Wo from the color components of the pixel data Pix1. In the case of the example illustrated in FIG. 5, the gradation values corresponding to the color components of the pixel data Pix1 are given as (Ro, Go, Bo)=(max, mid, mid). Thus, the white color component Wo is given as Wo=MIN(Ro, Go, Bo)=(mid, mid, mid). Color components ((Ro, Go, Bo)−Wo) other than the white color component Wo of the color components of the pixel data Pix1 are given as (R, G, B)=((max−mid), 0, 0).

The signal processor 20 multiplies each of the white color components Wo and We and the color components other than the white color components by a predetermined coefficient (for example, 0.5), and combines the thus obtained products to generate the output signals OP. In the example illustrated in FIG. 5, in the signal processing ed, the signal processor 20 individually multiplies the white color component Wo, the white color component We, and the color components ((Ro, Go, Bo)−Wo) and ((Re, Ge, Be)−We) other than the white color components by 0.5, and combines the thus obtained products to generate the output signals OP.

Figure 6:
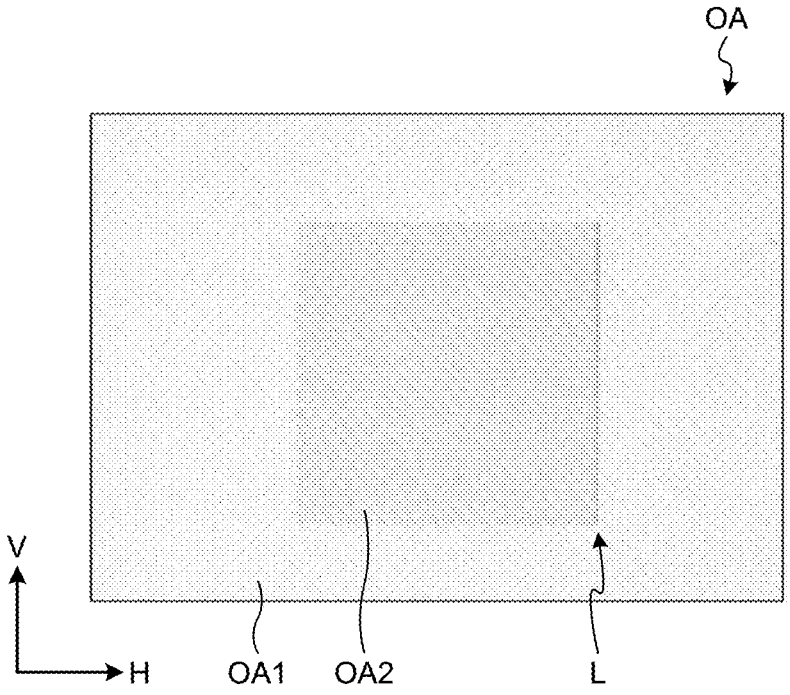
FIG. 6 is a view illustrating an example of a display area in which an image corresponding to output signals is displayed.
Figure 7:
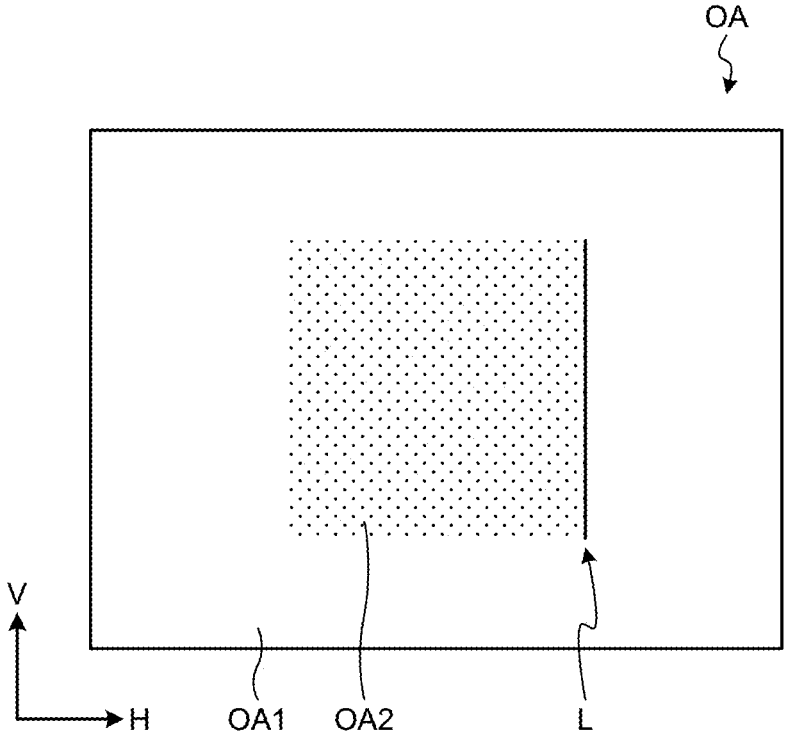
FIG. 7 is a diagram schematically expressing FIG. 6.

FIG. 6 is a view illustrating an example of the display area OA in which an image corresponding to the output signals OP is displayed. FIG. 7 is a diagram schematically expressing FIG. 6. If the signal processing ed described with reference to FIG. 5 is applied to all the input signals IP without exception, a line L not included in the input signals IP is sometimes made visible as illustrated, for example, in FIGS. 6 and 7. Specifically, the image illustrated in FIGS. 6 and 7 includes a white area OA1 and a yellow area OA2 surrounded by the white area OA1. The line L is made visible as a line in the yellow area OA2 that has a width of one pixel and is adjacent to the white area OA1. The line L is visible as if having a color different from yellow, as a line having lower luminance than that of the yellow area OA2.

Figure 8:
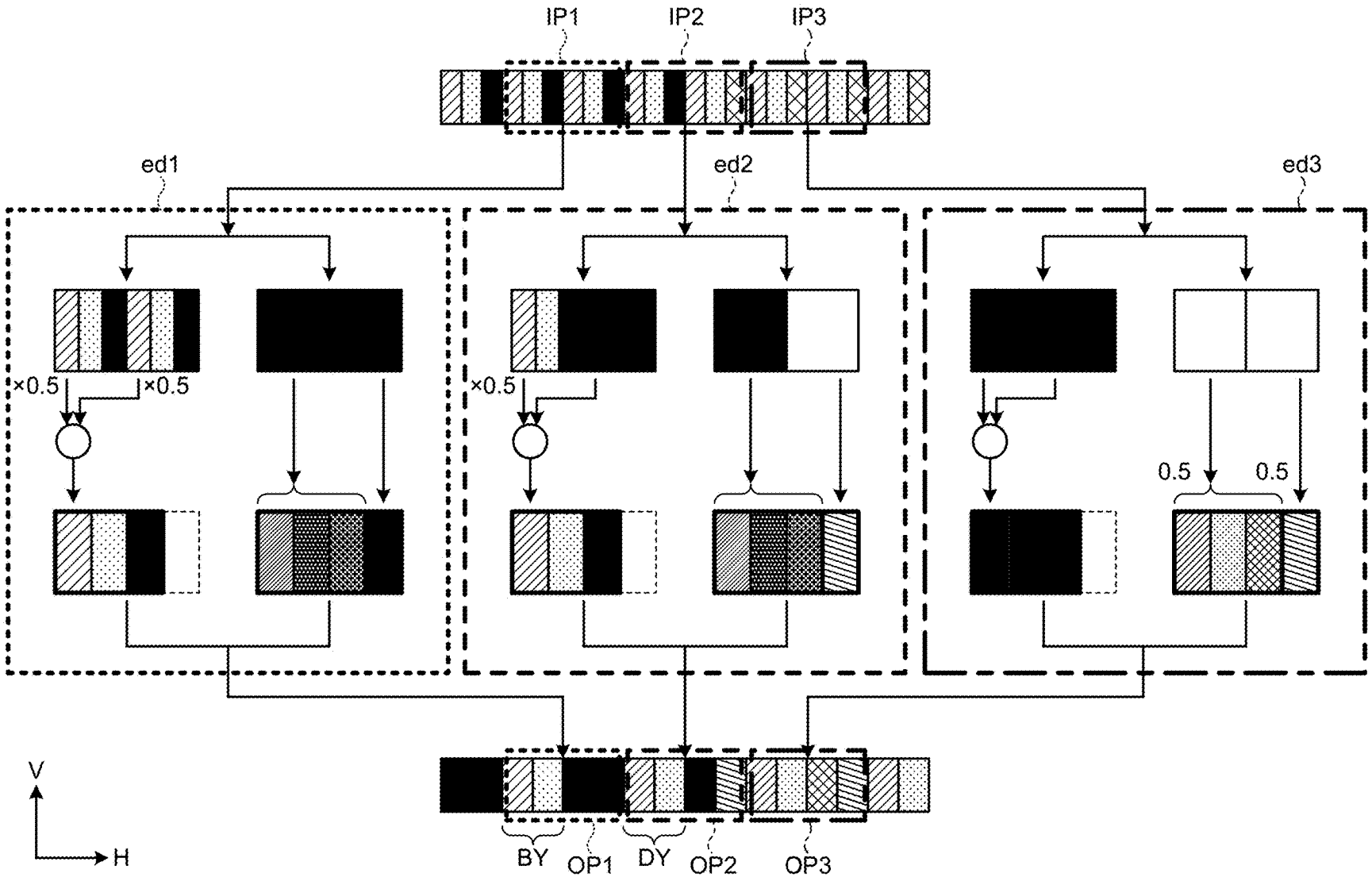
FIG. 8 is a diagram illustrating how a line is made visible.

FIG. 8 is a diagram illustrating how the line L is made visible. In FIG. 8, a minimum unit of the input signals IP for one set of the sub-pixels 49 (for example, the pixel 48) included in a row of the pixel data Pix arranged in the x-direction is illustrated as input signals IP1, IP2, and IP3. The input signals IP1, IP2, and IP3 are aligned in the order of the input signal IP1, the input signal IP2, and the input signal IP3 from one side toward the other side in the x-direction. Each of the input signals IP1, IP2, and IP3 includes color components corresponding to two pieces of the pixel data Pix, for example, the pixel data Pix1 and Pix2 in FIG. 5. In the input signal IP1, the two pieces of the pixel data Pix are both yellow at the highest gradation ((R, G, B)=(max, max, min)). The value of min is the minimum value of the gradation values of red (R), green (G), and blue (B) in the input signals IP. For example, if the gradation values are expressed as 8-bit values, min=0. In the input signal IP2, one (pixel data Pix2 in FIG. 5) of the two pieces of pixel data Pix from which a first color component is extracted represents white at the highest gradation ((R, G, B)=(max, max, max)). In the input signal IP2, the other of the two pieces of pixel data PIX represents yellow at the highest gradation ((R, G, B)=(max, max, min)). In the input signal IP3, both the two pieces of the pixel data Pix represent the white at the highest gradation ((R, G, B)=(max, max, max)).

For the purpose of distinction among operations of the signal processing ed and the output signals OP, FIG. 8 illustrates pieces of signal processing ed1, ed2, and ed3 based on the input signals IP1, IP2, and IP3, and output signals OP1, OP2, and OP3. That is, the signal processing ed1 is performed based on the input signal IP1 to output the output signal OP1 to a corresponding one pixel 48; the signal processing ed2 is performed based on the input signal IP2 to output the output signal OP2 to a corresponding one pixel 48; and the signal processing ed3 is performed based on the input signal IP3 to output the output signal OP3 to a corresponding one pixel 48. Each of the signal processing operations ed1, ed2, and ed3 is the same as the signal processing operation ed described with reference to FIG. 5. The output signals OP1, OP2, and OP3 are aligned in the order of the output signal OP1, the output signal OP2, and the output signal OP3 from one side toward the other side in the H-direction.

The signal processing ed1 assigns, to the first sub-pixel 49R and the second sub-pixel 49G, color components corresponding to the input signal IP1 in which both the two pieces of the pixel data Pix represent yellow at the highest gradation ((R, G, B)=(max, max, min)). In other words, the yellow components of the two pieces of the pixel data Pix are assigned to R and G (the first sub-pixel 49R and the second sub-pixel 49G) of the set of the sub-pixels 49. Consequently, the luminance of yellow BY reproduced by the first sub-pixel 49R and the second sub-pixel 49G included in the corresponding one pixel 48 supplied with the output signal OP1 is set to a luminance corresponding to that of the two pieces of the pixel data Pix representing the yellow at the highest gradation. The signal processing ed2 assigns, to the first sub-pixel 49R and the second sub-pixel 49G, color components corresponding to the yellow at the highest gradation ((R, G, B)=(max, max, min)) of one piece of the pixel data Pix of the color components of the two pieces of the pixel data Pix included in the input signal IP2. This is because the other piece of the pixel data Pix of the color components of the two pieces of the pixel data Pix included in the input signal IP2, that is, the pixel data Pix (pixel data Pix2 in FIG. 5) on the side from which the first color component is extracted represents the white at the highest gradation ((R, G, B)=(max, max, max)). In other words, the color components of the other piece of the pixel data Pix are all assigned as the first color component (white color component We in FIG. 5) to the fourth sub-pixel 49W, and are not assigned to the first, second, and third sub-pixels 49R, 49G, and 49B. Accordingly, the luminance of yellow DY reproduced by the first sub-pixel 49R and the second sub-pixel 49G included in the corresponding one pixel 48 supplied with the output signal OP2 is set to half the luminance of the yellow BY, that is, a luminance corresponding to that of one piece of the pixel data Pix representing the yellow at the highest gradation. The yellow exemplified in this description is the yellow at the highest gradation ((R, G, B)=(max, max, min)), but is not limited to the yellow at the highest gradation. Any color reproduced using the non-white sub-pixels 49 generates a difference in luminance (for example, by 2:1) depending on differences in color components in the same way.

In this way, the difference in luminance is generated (for example, by 2:1) between the yellow BY reproduced by one of the two pixels 48 aligned in the H-direction, which is supplied with the output signal OP1, and the yellow DY reproduced by the other of the two pixels 48, which is supplied with the output signal OP2, depending on the difference in color components. Consequently, the yellow DY reproduced by the other of the pixels 48 is visible as a darker color than the yellow BY reproduced by one of the two pixels 48, thereby causing the line L to be visible. In other words, in the input signals IP serving as a basis for the yellow DY visible as the line L, one (pixel data Pix2 in FIG. 5) of the two pieces of pixel data Pix from which the first color component is extracted represents white, as illustrated, for example, in the input signal IP2 in FIG. 8. Since the pixel data Pix from which the first color component is extracted represents white, the color components of the pixel data Pix are not assigned to the first, second, and third sub-pixels 49R, 49G, and 49B. As a result, the color reproduced by combination of the first, second, and third sub-pixels 49R, 49G, and 49B is lower in luminance than those of the input signals IP (for example, the input signal IP1) in which both the two pieces of the pixel data Pix represent colors other than white (for example, yellow). In this way, a bright-and-dark pattern not included in the input signals IP, for example, the line L, is sometimes made visible at a boundary between white and a color (for example, yellow) other than white.

In the signal processing ed3, both the two pieces of the pixel data Pix represent the white at the highest gradation ((R, G, B)=(max, max, max)). Thus, the color components of the pixel data Pix (pixel data Pix2 in FIG. 5) from which the first color component is extracted are all assigned as the first color component (white color component We in FIG. 5) to the fourth sub-pixel 49W. The color components of the other one of the two pieces of pixel data Pix are assigned as color components reproducing white to the first, second, and third sub-pixels 49R, 49G, and 49B.

In the embodiment, as described with reference to FIGS. 2 and 3, the pixels 48 are arranged in a staggered manner in the two dimensional HV coordinate system. Accordingly, even when rows in each of which the pixel data Pix is aligned in the same way as the input signals IP1, IP2, and IP3 are successively arranged in the column direction (y-direction), the position of a set (group) of two pieces of pixel data Pix serving as a basis for generating the output signals OP for one pixel 48 shifts in the x-direction by one set, between rows adjacent in the y-direction. For example, assume that q rows (where q is an even natural number) of the pixel data Pix in each of which the pixel date PIX is aligned in the same way as the input signals IP1, IP2, and IP3 are successively arranged in the column direction (y-direction). In this example, in the same way as in the example illustrated in FIG. 8, the grouping pattern of the two pieces of pixel data Pix in a half number (q/2) of rows of the pixel data Pix is a grouping pattern that forms groups including the white pixel data Pix and the pixel data Pix of a color other than white (for example, yellow) in the same way as the input signal IP2. The grouping pattern of the two pieces of pixel data Pix in a remaining half number (q/2) of rows of the pixel data Pix is not a grouping pattern that forms the groups including the white pixel data Pix and the pixel data Pix of a color other than white (for example, yellow) in the same way as the input signal IP2. Specifically, the grouping pattern is formed in which a group including only the white pixel data Pix in the same way as the input signal IP3 and a group including only the pixel data Pix of a color other than white in the same way as the input signal IP1 are arranged in the x-direction.

In other words, the situation of FIG. 8 occurs if the image display panel 30, which has the pixels 48 arranged in a staggered manner in the two dimensional HV coordinate system, receives an image including an area in which the q rows of the pixel data Pix are successively arranged in the y-direction, the pixel data Pix being arranged in the same way as the input signals IP1, IP2, and IP3, and having a color other than white (for example, yellow) located on one side and white located on the other side in the x-direction. In other words, the color reproduction by the output signals OP1, OP2, and OP3 in the same way as in FIG. 8 is performed in the half number (q/2) of rows, and thereby, the line L is made visible. Therefore, in the embodiment, exception handling ED is provided for restraining the generation of the line L1.

Figure 9:
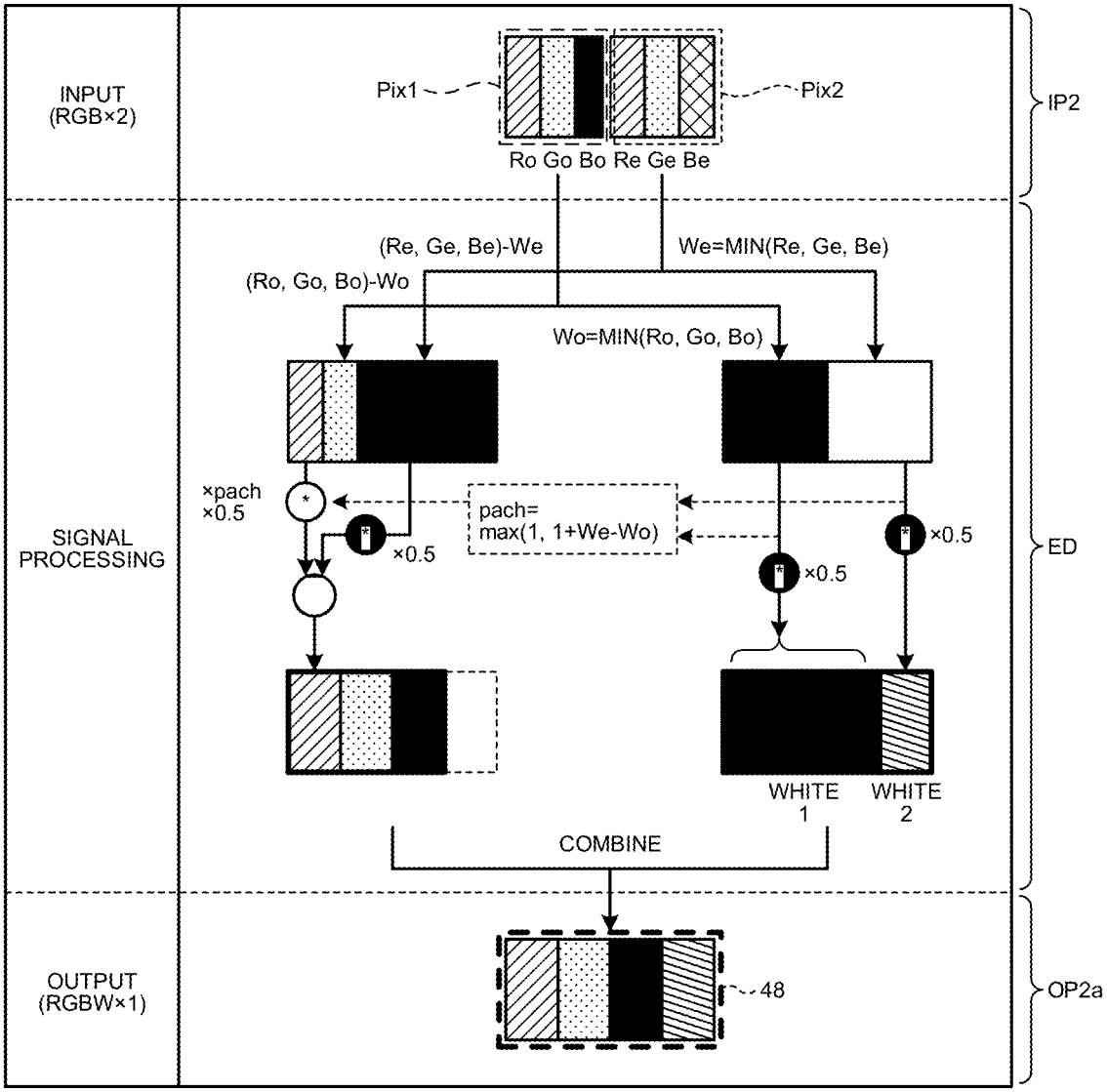
FIG. 9 is an explanatory diagram illustrating an example of exception handling.

FIG. 9 is an explanatory diagram illustrating an example of the exception handling ED. If one (pixel data Pix2 in FIG. 5) of the two pieces of pixel data Pix from which the first color component is extracted represents white at the highest gradation ((R, G, B)=(max, max, max)) and the other one of the two pieces of pixel data Pix represents a color other than white, the signal processor 20 performs the exception handling ED to increase signal levels corresponding to the second color components as the signal level corresponding to the first color component increases. More specifically, the signal processor 20 increases signal levels corresponding to color components of the second color components other than the white component as the difference increases between the signal level corresponding to at least the first color component and the signal level corresponding to the white color component included in the second color components. The "difference between signal levels" is not limited to a difference representable as a level of an absolute value of a signal level corresponding to a gradation value, and can be a difference as a level of deviation when expressed as a ratio.

The exception handling ED is applied when a first condition and a second condition are satisfied. The first condition is that, of the signal levels for controlling the lighting of the sub-pixels corresponding to the second color components, a signal level for lighting one or more of the sub-pixels 49 of the first, second, and third sub-pixels 49R, 49G, and 49B included in the set of the sub-pixels 49 is at a first signal level. The second condition is that, of the signal levels for controlling the lighting of the sub-pixels, a signal level for one or more of the first, second, and third sub-pixels 49R, 49G, and 49B included in the set of the sub-pixels 49 is at a second signal level lower than the first signal level. The first signal level is a signal level that sets the luminance of the sub-pixels 49 to luminance of, for example, 50% or higher of the highest luminance. When expressed in gradation value using min, mid, and max mentioned above, the first signal level is a signal level of the output signals OP corresponding to a gradation value equal to or higher than mid. The second signal level is a signal level that sets the luminance of the sub-pixels 49 to luminance of, for example, 10% or lower of the highest luminance. When expressed in gradation value using min, mid, and max mentioned above, the second signal level is a signal level of the output signals OP corresponding to a gradation value equal to or lower than (max/10). In the case of the input signal IP2, the signal level of the output signals OP supplied to the first sub-pixel 49R and the second sub-pixel 49G is the signal level corresponding to the gradation value equal to or higher than mid, and corresponds to the first signal level. In the case of the input signal IP2, the signal level of the output signal OP supplied to the third sub-pixel 49B is the signal level corresponding to the gradation value (0) equal to or lower than (max/10), and corresponds to the second signal level. Consequently, the exception handling ED is applied to the input signal IP2.

The input signal IP2 in FIG. 9 is the same as the input signal IP2 in FIG. 8. In the exception handling ED, the signal processor 20 extracts the white color components Wo and We extractable from the two pieces of the pixel data Pix1 and Pix2, respectively, included in the input signal IP2. The signal processor 20 calculates an exception handling coefficient pach using Expression (1) below.

$$\text{pach}=\max(1,1+We-Wo) \tag{1}$$

Each of the white color components Wo and We in Expression (1) takes a value within a value range from 0 to 1. Specifically, each of the white color components Wo and We takes the maximum value (1) when MIN(R, G, B)=(max, max, max), and each of the white color components Wo and We takes the minimum value (0) when MIN(R, G, B)=(min, min, min).

The exception handling coefficient pach takes a value within a value range from 1 to 2. For example, the exception handling coefficient pach takes the maximum value (2) when We=1 and Wo=0, and the exception handling coefficient pach takes the minimum value (1) regardless of the value of Wo when We=0. The exception handling coefficient pach takes the minimum value (1) when We=Wo.

In the case of the example illustrated in FIG. 9, the gradation values of the pixel data Pix2 included in the input signal IP2 are given as (Re, Ge, Be)=(max, max, max). Thus, the white color component We included in (Re, Ge, Be) is given as We=MIN(Re, Ge, Be)=(max, max, max). That is, We=1. The gradation values of the pixel data Pix1 included in the input signal IP2 are given as (Ro, Go, Bo)=(max, max, min). Thus, the white color component We included in (Re, Ge, Be) is given as We=MIN(Re, Ge, Be)=(min, min, min). That is, Wo=0. Accordingly, in the case of the example illustrated in FIG. 9, the exception handling coefficient pach takes the maximum value (2).

The signal processor 20 adds the exception handling coefficient pach as a coefficient of color components that are components other than the white color components among the color components to be combined into the output signals OP and are assigned to the first, second, and third sub-pixels 49R, 49G, and 49B. Specifically, as illustrated in FIG. 9, the signal processor 20 multiplies the color components ((Ro, Go, Bo)−Wo) other than the white color component Wo of the color components of the pixel data Pix1 by the coefficient (for example, 0.5) used as a multiplier in the signal processing ed, and in addition, by the exception handling coefficient pach (1≤pach≤2). This operation causes the signal levels of the color components ((Ro, Go, Bo)−Wo) other than the white color component Wo of the color components of the pixel data Pix1 to increase by one time or more to two times or less. The multiplication factor for the signal levels is applied as a multiplication factor for the gradation values.

In the exception handling ED, the coefficient, by which the white color components Wo and We and the color components other than the white color component We of the color components of the pixel data Pix2 are multiplied, is the same as the coefficient (for example, 0.5) used as the multiplier in the signal processing ed.

In the case of the example illustrated in FIG. 9, the exception handling coefficient pach has the maximum value (2). Thus, the color components ((Ro, Go, Bo)−Wo) other than the white color component Wo of the color components of the pixel data Pix1 are doubled in signal level. In other words, an output signal OP2*a* is obtained in which the color components corresponding to the yellow at the highest gradation ((R, G, B)=(max, max, min)) of one piece of the pixel data Pix of the color components of the two pieces of the pixel data Pix included in the input signal IP2 are doubled in signal level. The color components of the yellow in the output signal OP2*a* are twice as high in signal level as those in the output signal OP2 obtained by the signal processing ed.

Of the input signals IP1, IP2, and IP3, the input signal IP2 satisfies the conditions for applying the exception handling ED. When the signal processing ed applied to the input signal IP2 in the example illustrated in FIG. 8 is replaced with the exception handling ED, the output signal OP2*a* is obtained instead of the output signal OP2. In other words, the yellow DY reproduced by the first sub-pixel 49R and the second sub-pixel 49G included in the one pixel 48 supplied with the output signal OP2 in FIG. 8 is replaced with the yellow having the color components doubled in signal level by the output signal OP2*a*. The yellow obtained by being supplied with the output signal OP2*a* is yellow corresponding to the same color components as those of the yellow BY of the pixel 48 supplied with the output signal OP1. Consequently, the difference in luminance between the yellow colors reproduced by the two pixels 48 supplied with the output signals OP1 and OP2*a* is reduced. Applying the exception handling ED to the example illustrated in FIG. 8 eliminates the difference in luminance between the yellow colors reproduced by the two pixels 48 supplied with the output signals OP1 and OP2*a*. In other words, the line L, which would be visible due to the difference in luminance, is made invisible.

Figure 10:
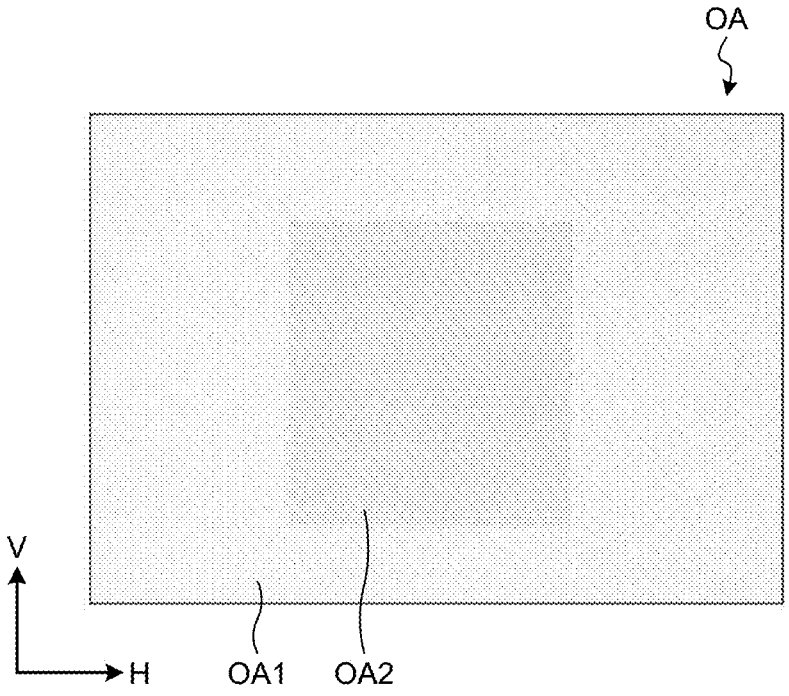
FIG. 10 is a view illustrating an example of the display area in which the image corresponding to the output signals subjected to the exception handling is displayed.

FIG. 10 is a view illustrating an example of the display area OA in which the image corresponding to the output signals OP subjected to the exception handling ED is displayed. As described above, since the exception handling ED eliminates the difference in luminance between the yellow DY and the yellow BY, which causes the line L to be visible, thereby causing the line L in the yellow area OA2 adjacent to the white area OA1 to be invisible, as illustrated in FIG. 10.

In the case of the example illustrated in FIG. 8, the input signal IP1 is also to be subjected to the exception handling ED in a strict sense. However, in the input signal IP1, the white color component We serving as the first color component is given as MIN(Re, Ge, Be)=(min, min, min). As a result, the exception handling coefficient pach takes the minimum value (1), and the output signal OP1 substantially equal to that obtained by the signal processing ed is obtained. The input signal IP3 is also to be subjected to the exception handling ED. However, also in this case, since Wo=1 and We=1, the exception handling coefficient pach takes the minimum value (1), and the output signal OP3 substantially equal to that obtained by the signal processing ed is obtained.

As described above, according to the embodiment, when both the first condition and the second condition are satisfied, the signal levels corresponding to the second color components are increased as the signal level corresponding to the first color component increases. This processing can restrain the visualization of the unintended bright-and-dark pattern, for example, the line L described above.

The first signal level is defined as the signal level that causes the luminance of the sub-pixels 49 to be a luminance of 50% or higher of the highest luminance, and the second signal level is defined as the signal level that causes the luminance of the sub-pixels 49 to be a luminance of 10% or lower of the highest luminance. Thereby, the exception handling ED can be applied more surely to the case where the first, second, and third sub-pixels 49R, 49G, and 49B are used for reproduction of a color other than white, and the visualization of the unintended bright-and-dark pattern, for example, the line L described above, can be more surely restrained.

When the sub-pixels 49 for each color are arranged in a staggered manner, the sets of the sub-pixels 49 (for example, the pixels 48) are also arranged in a staggered manner. Consequently, the input signals IP serving as a basis for the output signals OP are also sectioned in a staggered manner, and thus, the set of the two pieces of pixel data Pix is likely to be generated in which white is adjacent to a color other than white as illustrated for the input signal IP2. Therefore, the exception handling ED is applied, and thereby, the visualization of the unintended bright-and-dark pattern, for example, the line L described above, can be more surely restrained.

If, as described in the example with reference to FIGS. 6 to 8, the second color components are color components that reproduce yellow using the combination of the first, second, and third sub-pixels 49R, 49G, and 49B, the line L is easily made visible. This is because yellow is a color that makes contrast in brightness more clearly visible. Therefore, as described with reference to FIG. 9, the exception handling ED is performed based on the input signal IP, for example, the input signal IP2, including the two pieces of pixel data Pix in which yellow is adjacent to white, and thereby, the visualization of the unintended bright-and-dark pattern, for example, the line L described above, can be more surely restrained.

Modification

Figure 11:
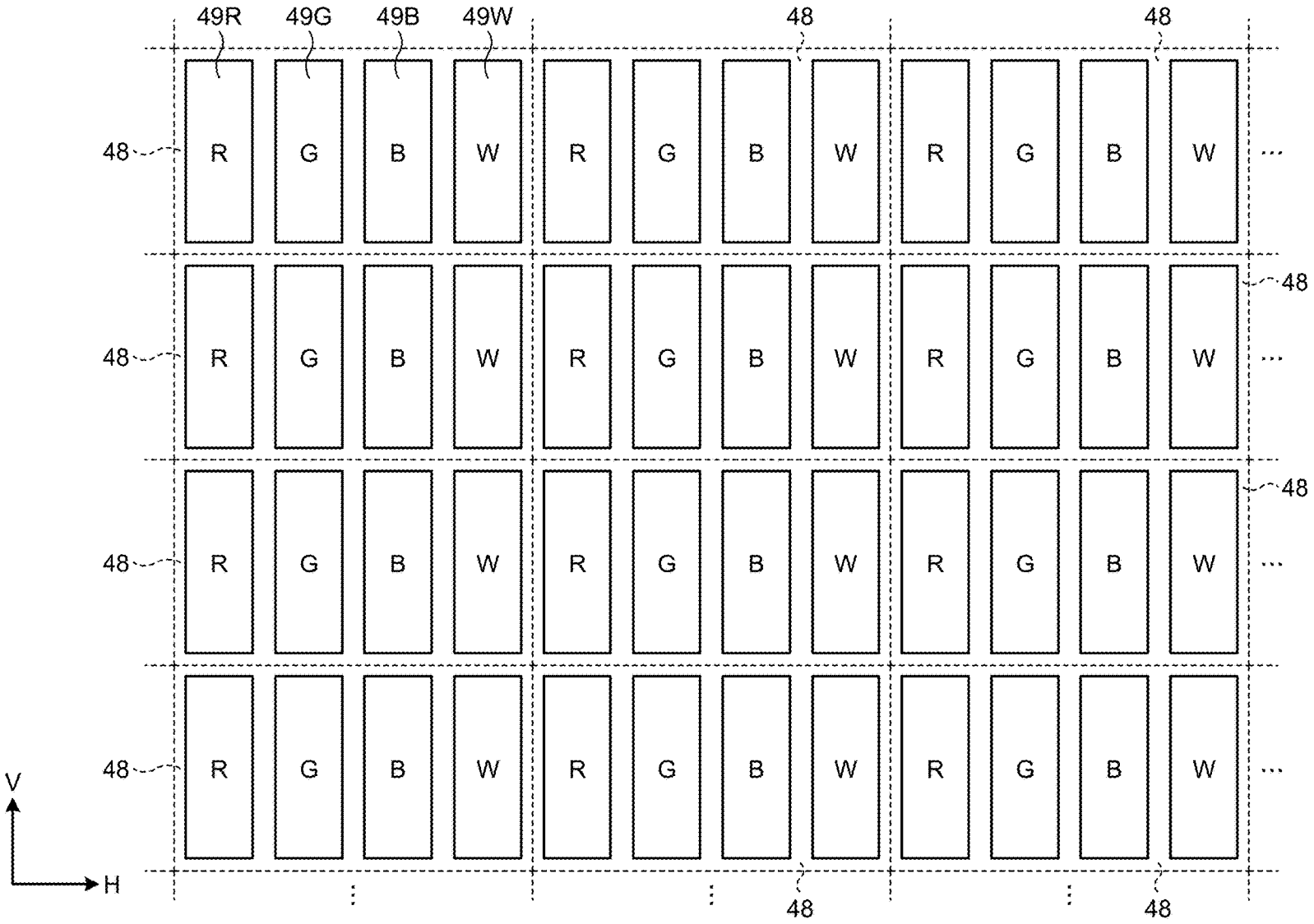
FIG. 11 is a schematic diagram illustrating the array of the pixels and the sub-pixels of the image display panel according to a modification.

FIG. 11 is a schematic diagram illustrating the array of the pixels and the sub-pixels of the image display panel according to a modification. In the modification illustrated in FIG. 11, the pixels 48 are arranged in a matrix (row-column configuration) in the two dimensional HV coordinate system. In other words, what is called a stripe array is formed in which the sub-pixels 49 are arranged periodically in the order of the first sub-pixel 49R, the second sub-pixel 49G, the third sub-pixel 49B, and the fourth sub-pixel 49W from one side toward the other side in one direction (for example, the H-direction) of the image display panel, and the sub-pixels 49 having the same color are arranged in the other direction (for example, the V-direction). In general, arrays similar to the stripe array are suitable for displaying data or character strings on a personal computer or the like.

In the stripe array as illustrated in FIG. 11, the input signal IP including the two pieces of pixel data Pix in which white is adjacent to a color other than white is generated as exemplified by the input signal IP2 illustrated in FIG. 8 in some cases, but not in other cases. In other words, if a border line between sets of the sub-pixels 49 (for example, the pixels 48) coincides with a border line between white and a color other than white in the input signal IP, the line L is not visible regardless of the application of the exception handling ED. If, instead, the border lines do not coincide, the line L is visible unless the exception handling ED is applied, in some cases. Therefore, also in the stripe array, the application of the exception handling ED can more surely restrain the visualization of the unintended bright-and-dark pattern, for example, the line L described above.

The relation between the row direction (H-direction) and the column direction (V-direction) in the above description may be reversed. In this case, the relation between the x-direction and the y-direction is also reversed. Although the above description has exemplified the case where the display device 10 is a transmissive color liquid crystal display device, the display device 10 is not limited thereto. Other application examples of the display device include any type of flat-panel image display devices, including light-emitting display devices such as transflective or reflective liquid crystal display devices, display devices using organic electroluminescence (EL), and the like, and electronic paper display devices having, for example, electrophoretic elements. The present invention can obviously be applied to display devices of small, medium, and large sizes without particular limitation.

Other operational advantages accruing from the aspects described in the embodiments that are obvious from the description herein or that are appropriately conceivable by those skilled in the art will naturally be understood as accruing from the present invention.

What is claimed is:

1. A display device comprising:

a display unit in which a plurality of sub-pixels are arranged in a matrix along row and column directions; and a signal processor configured to output output signals generated based on signals constituting image data in which pixel data including three colors of red, green, and blue is arranged in a matrix, wherein a set of the sub-pixels comprises a first sub-pixel for red, a second sub-pixel for green, a third sub-pixel for blue, and a fourth sub-pixel for white, wherein either the first sub-pixel or the third sub-pixel is interposed between the second sub-pixel and the fourth sub-pixel arranged in one direction of the row direction and the column direction, wherein color components assigned to two pieces of the pixel data arranged in the one direction are assigned to one set of the sub-pixels included in the display unit, wherein the one set of the sub-pixels is made up of the first sub-pixel, the second sub-pixel, the third sub-pixel, and the fourth sub-pixel, wherein the fourth sub-pixel is assigned a first color component serving as a white component included in one piece of the pixel data among the color components included in the two pieces of the pixel data, wherein the first sub-pixel, the second sub-pixel, and the third sub-pixel are assigned second color components other than the first color component of the color components included in the two pieces of the pixel data, and wherein when, of signal levels for controlling lighting of the sub-pixels corresponding to the second color components, a signal level for lighting one or more of the first sub-pixel, the second sub-pixel, and the third sub-pixel included in the set of the sub-pixels is at a first signal level, and a signal level for one or more of the first sub-pixel, the second sub-pixel, and the third sub-pixel is at a second signal level lower than the first signal level, the signal processor increases the signal levels corresponding to the second color components as a signal level corresponding to the first color component increases.

2. The display device according to claim 1, wherein the first signal level is a signal level that causes the luminance of the sub-pixels to be a luminance of 50% of the highest luminance or higher, and wherein the second signal level is a signal level that causes the luminance of the sub-pixels to be a luminance of 10% of the highest luminance or lower.

3. The display device according to claim 1, wherein the sub-pixels having the same color are arranged along the column direction in the display unit.

4. The display device according to claim 1, wherein the sub-pixels for each color are arranged in a staggered manner along the column direction in the display unit.

5. The display device according to claim 1, wherein the second color components are color components that reproduce yellow by combining the first sub-pixel, the second sub-pixel, and the third sub-pixel.

6. The display device according to claim 1, wherein the signal processor configured to increase signal levels corresponding to color components other than the white component of the second color components as a difference increases between the signal level corresponding to the first color component and a signal level corresponding to the white component included in the second color components.

* * * * *